US010930258B2

(12) United States Patent
Yoshino

(10) Patent No.: US 10,930,258 B2
(45) Date of Patent: Feb. 23, 2021

(54) ELECTRONIC PERCUSSION INSTRUMENT AND DETECTION METHOD USING THE SAME

(71) Applicant: Roland Corporation, Shizuoka (JP)

(72) Inventor: Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/443,884

(22) Filed: Jun. 18, 2019

(65) Prior Publication Data

US 2019/0392804 A1 Dec. 26, 2019

(30) Foreign Application Priority Data

Jun. 20, 2018 (JP) ..... JP2018-117223

(51) Int. Cl.
*G10H 3/10* (2006.01)
*G10H 3/14* (2006.01)

(52) U.S. Cl.
CPC ..... *G10H 3/10* (2013.01); *G10H 3/146* (2013.01)

(58) Field of Classification Search
CPC ..... G10H 1/00; G10H 2220/521; G10H 2220/525; G10H 3/146; G10H 1/32; G10H 1/0551; G10H 2230/285; G10H 2230/301; G10H 3/10; G10H 2220/535; G10H 2230/311; G10H 2230/315; G10H 3/143; G10K 11/04
See application file for complete search history.

(56) References Cited

U.S. PATENT DOCUMENTS 4,852,443 A * 8/1989 Duncan ..... G10H 1/0551 84/733
5,042,356 A * 8/1991 Karch ..... G10D 13/02 84/725
5,920,026 A * 7/1999 Yoshino ..... G10D 13/024 84/414
5,922,981 A * 7/1999 Ballister ..... A63J 17/00 84/464 A
6,271,458 B1 * 8/2001 Yoshino ..... G10H 3/146 84/414
7,408,109 B1 8/2008 Freitas
7,465,869 B1 12/2008 Freitas
(Continued)

FOREIGN PATENT DOCUMENTS

CN 201477865 5/2010
CN 202905150 4/2013
(Continued)

*Primary Examiner* — Marlon T Fletcher
(74) *Attorney, Agent, or Firm* — JCIPRNET

(57) ABSTRACT

Provided is an electronic percussion instrument that can facilitate determination of contact of a detection target conductor with a head. An electronic percussion instrument includes: a tubular body portion with an end surface in an axial direction open; a head that covers the open end surface in the axial direction of the body portion and has a front surface adapted to be hit; and a capacitive sensor that has an electrode disposed on a rear surface side of the head, in which the head includes an electrically isolated conductive head, and no conductor connected to a reference potential point is provided between the front surface of the head and the electrode. In this manner, it is possible to facilitate determination of contact of the detection target conductor with the head.

22 Claims, 9 Drawing Sheets

(56) References Cited

U.S. PATENT DOCUMENTS 8,563,843 B1 * 10/2013 Shemesh ..... G10H 7/00 84/723
9,947,307 B2 * 4/2018 Takasaki ..... G10D 13/024
2004/0083873 A1 * 5/2004 Yoshino ..... G10D 13/024 84/107
2004/0118269 A1 * 6/2004 Yoshino ..... G10H 3/146 84/723
2004/0200338 A1 * 10/2004 Pangrle ..... G10H 3/06 84/724
2005/0150366 A1 * 7/2005 Susami ..... G10H 3/146 84/735
2006/0021495 A1 2/2006 Freitas
2007/0051231 A1 * 3/2007 Fujii ..... G10D 13/024 84/723
2007/0163423 A1 * 7/2007 Rogers ..... G10D 13/029 84/411 R
2008/0238448 A1 10/2008 Moore et al.
2010/0307323 A1 * 12/2010 Mori ..... G10D 13/023 84/723
2010/0313732 A1 * 12/2010 Yoshino ..... G10D 13/023 84/413
2012/0097009 A1 * 4/2012 Eventoff ..... G10D 13/02 84/413
2013/0180388 A1 * 7/2013 Mori ..... G10H 3/14 84/723
2014/0060211 A1 3/2014 Van den Broeck
2014/0260917 A1 * 9/2014 Kanayama ..... G10H 3/143 84/730
2014/0260918 A1 * 9/2014 Kanayama ..... G10H 3/146 84/730
2014/0260919 A1 * 9/2014 Kanayama ..... G10H 3/146 84/730
2014/0260920 A1 * 9/2014 Kanayama ..... G10H 3/146 84/730
2014/0260921 A1 * 9/2014 Kanayama ..... G10H 3/146 84/730
2015/0221290 A1 * 8/2015 Wei ..... G10D 13/006 84/730
2015/0294658 A1 * 10/2015 Gill ..... G10H 3/12 84/723
2017/0236505 A1 * 8/2017 Takasaki ..... G10D 13/02 84/723
2019/0172435 A1 * 6/2019 Zhong ..... G10D 13/02
2019/0392804 A1 * 12/2019 Yoshino ..... G10H 3/146

FOREIGN PATENT DOCUMENTS

CN 202905153 4/2013
CN 205609205 9/2016
JP 2009237296 10/2009
JP 2017146461 8/2017

* cited by examiner

ELECTRONIC PERCUSSION INSTRUMENT AND DETECTION METHOD USING THE SAME

CROSS-REFERENCE TO RELATED APPLICATION

This application claims the priority benefit of Japan application serial no. 2018-117223, filed on Jun. 20, 2018. The entirety of the above-mentioned patent application is hereby incorporated by reference herein and made a part of this specification.

BACKGROUND

Technical Field

The disclosure relates to an electronic percussion instrument and a detection method that can facilitate determination of contact of a detection target conductor with a head.

Description of Related Art

In the related art, an electronic percussion instrument that imitates a percussion instrument such as an acoustic drum in which an electrode of a capacitive sensor is disposed on a rear surface side of a head is known (Patent Document 1). According to the electronic percussion instrument, change in capacitance in accordance with a distance between a detection target conductor such as a hand of a player and the electrode is detected by the capacitive sensor, and an approach of the detection target conductor to the head is determined from a detection value of the capacitive sensor.

PATENT DOCUMENTS

[Patent Document 1] Japanese Patent Laid-Open No. 2017-146461

However, in regard to the aforementioned technology in the related art, it is desired to facilitate determination of contact of the detection target conductor with the head.

The disclosure provides an electronic percussion instrument and a detection method that can facilitate determination of contact of a detection target conductor with a head.

SUMMARY

According to an embodiment, there is provided an electronic percussion instrument including: a tubular body portion with an end surface in an axial direction open; a head that covers the open end surface in the axial direction of the body portion and has a front surface adapted to be hit; and a capacitive sensor that has an electrode disposed on a rear surface side of the head, in which the head includes an electrically isolated conductive head, and no conductor connected to a reference potential point is provided between the front surface of the head and the electrode.

In addition, according to an embodiment, there is provided an electronic percussion instrument including: a tubular body portion with an end surface in an axial direction open; a head that covers the open end surface in the axial direction of the body portion and that has a front surface adapted to be hit; an annular rim that is secured on an outer peripheral side of the body portion; an annular frame portion, to which an outer edge of the head is secured, and which is pressed with the rim and applies a tensile force to the head; and a capacitive sensor that has an electrode disposed on a rear surface side of the head, in which the head is provided such that a conductive head is pinched between a first head of an insulating body and a second head of the insulating body in order for the conductive head to be electrically isolated.

In addition, according to an embodiment, there is provided an electronic percussion instrument including: a head that has a front surface adapted to be hit, has a conductivity, and is electrically isolated; and a capacitive sensor that is disposed on a rear surface side of the head and induces a capacitance in accordance with a distance from a detection target conductor located on a front surface side of the head.

Also, according to an embodiment, there is provided a detection method using an electronic percussion instrument that includes a head that is electrically isolated and has a conductivity and a capacitive sensor that is disposed on a rear surface side of the head, the detection method including: determining that a detection target conductor has approached the head beyond a predetermined distance, on the basis of a rate of change in a capacitance between the capacitive sensor and the detection target conductor in accordance with a distance between the detection target conductor and the head.

In addition, according to an embodiment, there is provided an electronic percussion instrument including: a head that includes an electrically isolated conductive head and has a front surface adapted to be hit; and a capacitive sensor that has an electrode disposed on a rear surface side of the head, in which an area of a portion of the electrically isolated conductive head facing the electrode is larger than an area of a hand.

DESCRIPTION OF THE EMBODIMENTS

Figure 1:
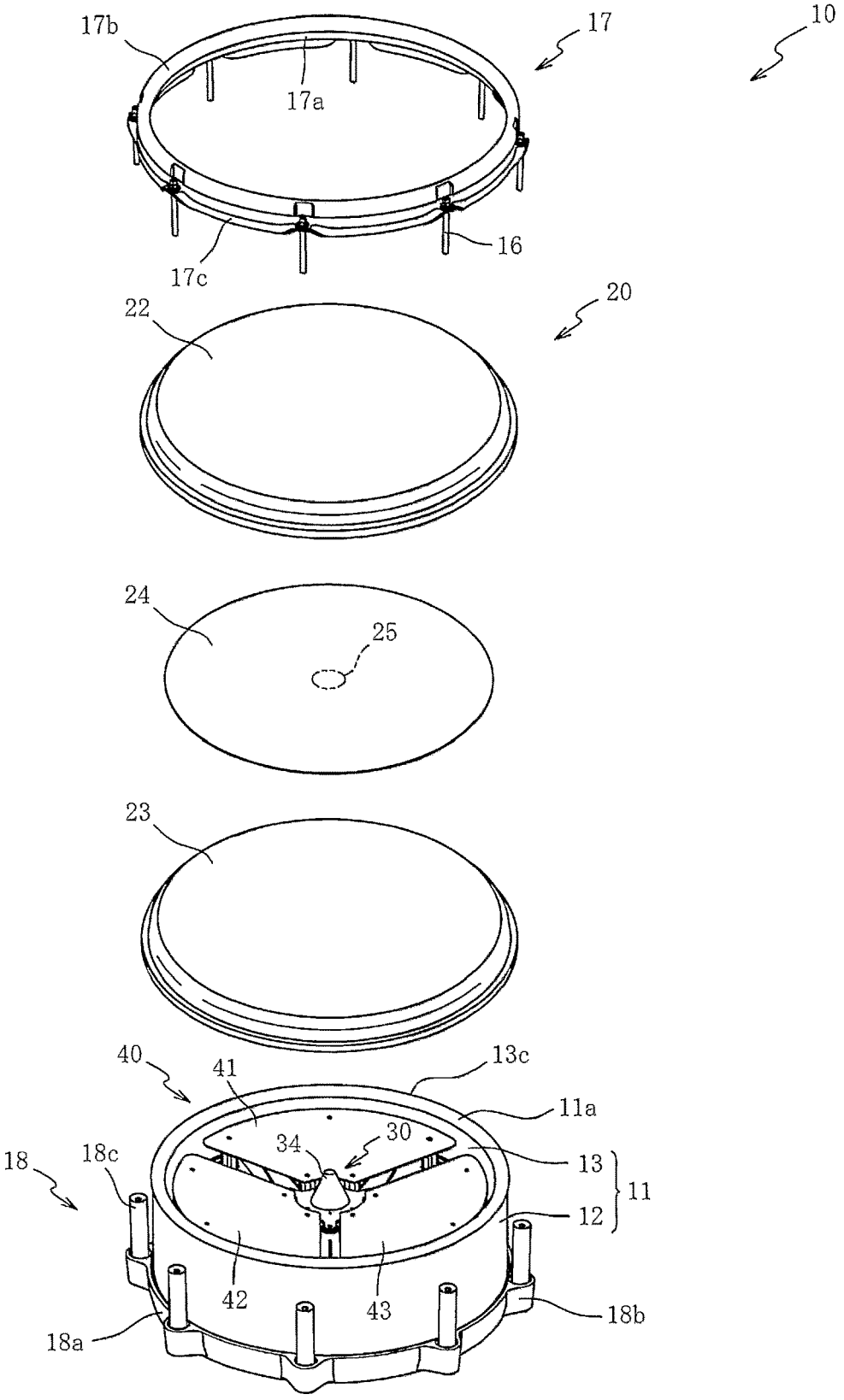
FIG. 1 is an exploded perspective view of an electronic percussion instrument according to a first embodiment.
Figure 2:
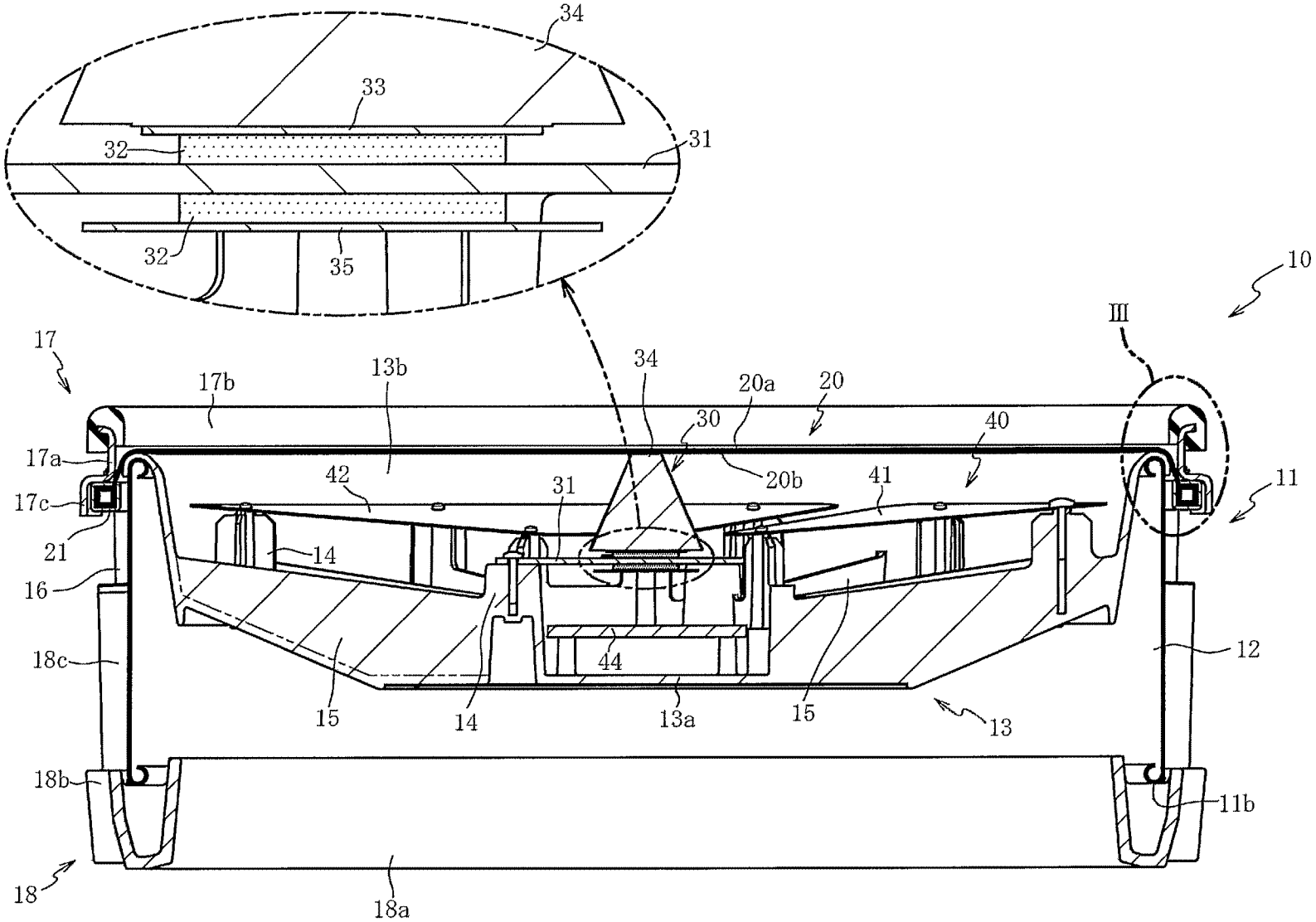
FIG. 2 is a sectional view of the electronic percussion instrument.
Figure 3:
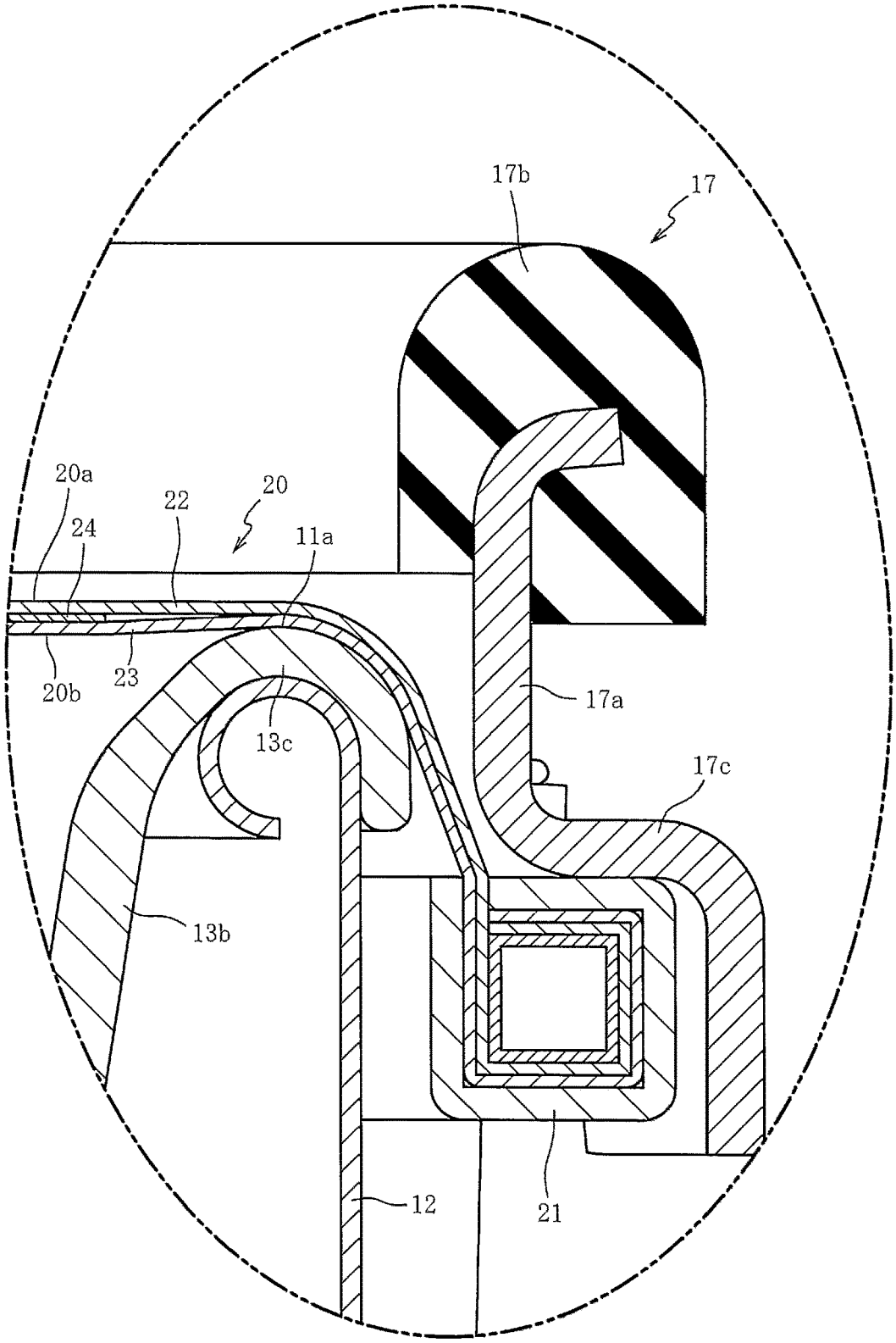
FIG. 3 is a partially enlarged sectional view of the electronic percussion instrument illustrating the part III in FIG. 2 in an enlarged manner.
Figure 4:
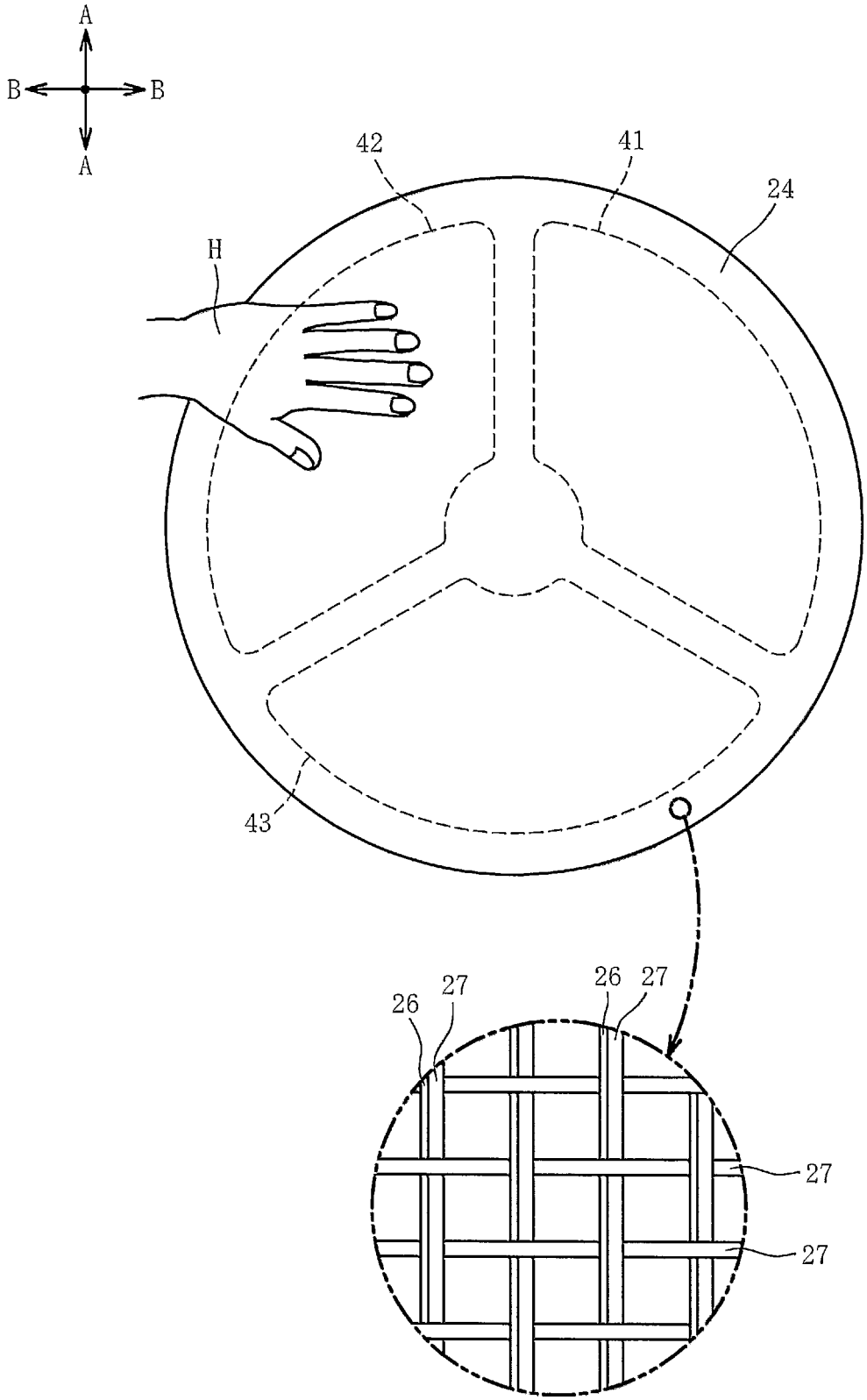
FIG. 4 is a schematic view illustrating a positional relationship between a conductive head and each electrode.

Hereinafter, preferred embodiments will be described with reference to accompanying drawings. First, an electronic percussion instrument 10 will be described with reference to FIG. 1, FIG. 2, FIG. 3, and FIG. 4. FIG. 1 is an exploded perspective view of the electronic percussion instrument 10 according to a first embodiment. FIG. 2 is a sectional view of the electronic percussion instrument 10. FIG. 3 is a partially enlarged sectional view of the electronic percussion instrument 10 illustrating the part III in FIG. 2 in an enlarged manner. FIG. 4 is a schematic view illustrating a positional relationship between a conductive head 24 and the respective electrodes 41, 42, and 43. Note that description will be given on the assumption that the upper side of the paper surface of FIG. 1 is an upper side of the electronic percussion instrument 10 and the lower side of the paper surface of FIG. 1 is a lower side of the electronic percussion instrument 10.

As illustrated in FIG. 1 and FIG. 2, the electronic percussion instrument 10 is an electronic instrument that imitates a drum that is played using sticks or the like that a player holds. The electronic percussion instrument 10 includes a body portion 11, a head 20, a rim 17, a securing portion 18, a sensor portion 30, and a capacitive sensor 40.

The electronic percussion instrument 10 is adapted such that the player hits the head 20 or the rim 17 using sticks or the like (not illustrated), and the electronic percussion instrument 10 outputs a detection result from the sensor portion 30 based on the hit to a sound source device (not illustrated). Also, the electronic percussion instrument 10 outputs a detection result from the capacitive sensor 40 to the sound source device. Then, a music sound signal based on these detection results is generated by the sound source device. The music sound signal is output to a speaker (not illustrated) via an amplifier (not illustrated), and electronic music sound based on the music sound signal is released from the speaker. Note that the sound source device, the speaker, and the like may be provided in the electronic percussion instrument 10 or the sound source device, the speaker, and the like may be provided as external devices.

The body portion 11 is a substantially tubular member that has a first end 11*a* and a second end 11*b* in an axial direction with both end surfaces thereof opened. The body portion 11 includes a shell 12 and a frame 13. The shell 12 is made of a tubular metal (conductor) with both end surfaces in the axial direction open. A lower end of the shell 12 is the second end 11*b*.

The frame 13 is a bowl-shaped member made of synthetic resin (insulating body). Various members such as the sensor portion 30 and the capacitive sensor 40 are attached to the frame 13. The frame 13 includes a bottom portion 13*a*, a side wall portion 13*b*, a hooked portion 13*c*, a plurality of projecting portions 14, and a plurality of ribs 15.

The bottom portion 13*a* is a substantially disc-shaped portion that is disposed a predetermined distance away from the head 20. The side wall portion 13*b* is a substantially cylindrical portion that stands from an outer peripheral edge of the bottom portion 13*a*. The hooked portion 13*c* is a substantially annular portion that is provided at an upper end edge of the side wall portion 13*b*. The frame 13 is attached to the shell 12 by the hooked portion 13*c* being hooked at the upper end of the shell 12. The hooked portion 13*c* forms the first end 11*a* of the body portion 11.

The projecting portions 14 are shaft-shaped portions extending from the bottom portion 13*a* toward the head 20. The sensor portion 30, the capacitive sensor 40, and the like are attached to upper ends of the projecting portions 14. The ribs 15 are plate-shaped portions for securing strength and rigidity of the frame 13. The ribs 15 are formed integrally with the bottom portion 13*a* and the projecting portions 14.

The head 20 is a film-shaped member that covers an end surface of the body portion 11 in the axial direction on the side of the first end 11*a*. A front surface 20*a* of the head 20 is hit by sticks or the like that the player holds. A rear surface 20*b* of the head 20 faces the side of the body portion 11.

As illustrated in FIG. 3, the head 20 includes a frame portion 21, a first head 22, a second head 23, and a conductive head 24. The frame portion 21 is an annular portion that is made of a metal material, a resin material, or the like using predetermined synthesis. The frame portion 21 is disposed on the outer peripheral side of the body portion 11.

The first head 22, the second head 23, and the conductive head 24 are circular films that are overlaid on each other in the vertical direction. The first head 22 forms the front surface 20*a*. The second head 23 forms the rear surface 20*b*. The first head 22 and the second head 23 are made of synthetic resin films or network-form materials that are insulating bodies. The first head 22 and the second head 23 respectively have outer edges secured to the frame portion 21.

The conductive head 24 is pinched between the first head 22 and the second head 23. The diameter of the conductive head 24 is smaller than the inner diameter of the frame portion 21. As illustrated in FIG. 1, the conductive head 24 includes a joint portion 25 provided at the center thereof. The joint portion 25 is a portion that restricts relative displacement of the conductive head 24 with respect to the first head 22 and the second head 23.

In the embodiment, the conductive head 24 is bonded to the first head 22 with the joint portion 25. Note that the conductive head 24 may be bonded to the second head 23 with the joint portion 25. Also, the conductive head 24 may be bonded to both the first head 22 and the second head 23 with the joint portion 25. In addition, sewing, adhesion, viscous adhesion, welding and the like may be exemplified as bonding methods using the joint portion 25.

As illustrated in FIG. 4, the conductive head 24 includes a plainly woven network-form material of fibers in a first direction A and fibers in a second direction B that are orthogonal to each other. The fibers in the first direction A are a combination of conductive portions 26 and non-conductive portions 27. The fibers in the second direction B are non-conductive portions 27. Note that although the non-conductive portions 27 and the conductive portions 26 that are the fibers in the first direction A are adjacent to each other in FIG. 4, the non-conductive portions 27 and the conductive portions 26 may be separated from each other.

The conductive portions 26 are fibers that are conductors provided so as to extend in the first direction A. Carbon fibers, for example, are used for the fibers forming the conductive portions 26. The plurality of conductive portions 26 are separated from each other in the second direction B. Note that any fibers may be used to form the conductive portions 26 as long as a resistance value thereof per 1 cm is equal to or less than about 100 kΩ.

The non-conductive portions 27 are made of insulating material fibers such as nylon. The conductive head 24 is formed by the plurality of conductive portions 26 being woven in and secured to the network-form material of the plurality of non-conductive portions 27. It is possible to prevent adjacent conductive portions 26 from being brought into contact with each other by the non-conductive portions 27 being disposed between adjacent conductive portions 26.

As illustrated in FIG. 2 and FIG. 3, the rim 17 is a substantially annular member that applies tensile force to the head 20. The rim 17 is disposed on the outer peripheral side of the body portion 11. The rim 17 includes a frame contact portion 17*a*, an elastic member 17*b*, and a flange 17*c*.

The frame contact portion 17*a* is a substantially cylindrical portion with a lower end in contact with the frame portion 21. The elastic member 17*b* is a substantially annular portion that is provided over the entire periphery of the upper end of the frame contact portion 17*a*. The elastic member 17*b* is made of an elastic material such as sponge, rubber, or a thermoplastic elastomer and is hit by the player. In this manner, it is possible to reduce hitting sound generated when the rim 17 is hit.

The flange 17*c* is an annular plate-shaped portion that sticks out from the lower end of the frame contact portion 17*a* outwards in the radial direction. The flange 17*c* is provided with a plurality of holes (not illustrated) into which bolts 16 are inserted. The flange 17*c* presses the frame portion 21 downward (toward the side of the second end 11*b*) along with the frame contact portion 17*a*.

The securing portion 18 is a member for securing the rim 17 to the body portion 11. The securing portion 18 includes an annular portion 18*a*, a plurality of sticking-out portions 18*b*, and a plurality of tube portions 18*c*. The annular portion 18*a* is an annular portion secured to the second end 11*b* (see FIG. 2) of the body portion 11. The plurality of sticking-out portions 18*b* are portions that are formed to stick out from the annular portion 18*a* outwards in the radial direction. The plurality of sticking-out portions 18*b* are disposed at equal intervals in the circumferential direction of the annular portion 18*a*.

The plurality of tube portions 18*c* are cylindrical portions that respectively extend from the sticking-out portions 18*b* toward the side of the first end 11*a*. The tube portions 18*c* are disposed on the outer peripheral side of the body portion 11. The tube portions 18*c* have female screws, into which bolts 16 are fitted, in the inner peripheral surfaces thereof.

The head 20 is attached to the body portion 11 by the rim 17 being placed on the frame portion 21 of the head 20 covering the first end 11*a* of the body portion 11 and by the bolts 16 penetrating through the rim 17 being fitted into the tube portions 18*c*. The frame portion 21 is pressed downward by fastening the bolts 16. Thus, tensile force is applied to the first head 22 and the second head 23 with outer edges secured to the frame portion 21.

At this time, since the outer edge of the conductive head 24 is not secured to the frame portion 21, it is possible to perform control such that substantially no tensile force is applied to the conductive head 24. Further, the conductive head 24 is located on the inner side in the radial direction beyond a contact position of the head 20 (second head 23) and the first end 11*a* of the body portion 11. In this manner, the conductive head 24 is pinched between the first head 22 and the first end 11*a* of the body portion 11, and it is thus possible to prevent tensile force from being applied to the conductive head 24. As a result, it is possible to improve durability of the conductive head 24.

Since the conductive head 24 is pinched between the first head 22 and the second head 23, to which the tensile force is applied, the position of the conductive head 24 can be fixed with a simple configuration. Further, since relative displacement of the conductive head 24 with respect to the first head 22 and the second head 23 is restricted by the joint portion 25, the position of the conductive head 24 can be fixed even before the tensile force is applied to the first head 22 and the second head 23. In this manner, it is possible to prevent a part of the conductive head 24 from becoming located outside the contact position of the head 20 and the first end 11*a*.

Further, since only a part of the center of the conductive head 24 is secured to the first head 22 with the joint portion 25, it is possible to inhibit extension of the conductive head 24 in the radial direction with the extension of the first head 22 in the radial direction. In this manner, it is possible to make it more difficult for the tensile force to be applied to the conductive head 24 and thereby to further improve durability of the conductive head 24.

In addition, since the first head 22 and the second head 23 are made of insulating bodies, it is possible to electrically insulate, with a simple configuration, the conductive head 24 that is pinched between the first head 22 and the second head 23 such that the conductive head 24 is not in contact with the frame portion 21. As a result, it is possible to facilitate manufacturing of the head 20 that has the electrically isolated conductive head 24. Note that the expression "electrically isolated" indicates a state in which the component is not electrically connected to any of a reference potential point (ground), various wirings, electronic components, and the like. However, a case in which a detection target conductor such as a hand H (see FIG. 4) is caused to be brought into direct contact with the conductive head 24 and a state where the hand H and the conductive head 24 are electrically connected to each other is achieved is excluded.

As illustrated in FIG. 2, the sensor portion 30 is a sensor that detects that the electronic percussion instrument 10 has been hit. The sensor portion 30 is attached to the center of the frame 13. The sensor portion 30 includes a plate 31, a head sensor 33, a cushion 34, and a rim sensor 35.

The head sensor 33 is attached to an upper surface of the plate 31 that is attached to a tip end of the projecting portion 14 via a double-sided tape 32. The rim sensor 35 is attached to a lower surface of the plate 31 via the double-sided tape 32. The head sensor 33 and the rim sensor 35 are disc-shaped sensors including piezoelectric elements.

Vibration of the head 20 that has been hit is mainly delivered to the head sensor 33 via the cushion 34. Vibration generated when the rim 17 has been hit is mainly delivered to the rim sensor 35 via the frame 13 or the like. Detection results (output level ratios) of the head sensor 33 and the rim sensor 35 differ from each other due to a difference in the delivery routes, and which of the head 20 and the rim 17 has been hit is determined.

As illustrated in FIG. 1 and FIG. 2, the capacitive sensor 40 is a self-capacitance sensor that detects that a detection target conductor such as a human body has approached the head 20. The capacitive sensor 40 includes a first electrode 41, a second electrode 42, a third electrode 43, and a control board 44. The first electrode 41, the second electrode 42, and the third electrode 43 (hereinafter, referred to as "the respective electrodes 41, 42, and 43") are electrically connected to the control board 44 via a wiring (not illustrated).

The respective electrodes 41, 42, and 43 are fan plate-shaped conductors (for example, of a metal, a conductive polymer, or graphite) with respect to a shaft center of the body portion 11. The respective electrodes 41, 42, and 43 have the same shape. In this manner, it is possible to reduce the number of types of component and to reduce the component costs of the respective electrodes 41, 42, and 43. Also, the respective electrodes 41, 42, and 43 can be regarded as being obtained by dividing an electrode with a circular shape in a top view at equal intervals in the circumferential direction of the body portion 11.

The respective electrodes 41, 42, and 43 are secured to tip ends of the projecting portions 14 and are disposed at predetermined distances from the bottom portion 13*a* and the head 20. The respective electrodes 41, 42, and 43 are slightly inclined downward toward the center of the body portion 11 and are provided substantially parallel to the head 20. The respective electrodes 41, 42, and 43 face the head 20.

A detection method of the capacitive sensor 40 will be described. First, in a state in which the hand H (see FIG. 4)

of the player, which is a detection target conductor, has not approached the head 20, predetermined capacitances (parasitic capacitances) are generated between a conductor (a wiring or the like in the control board 44) connected to a reference potential point (not illustrated) in the control board 44 or a grounded portion (connected to the reference potential point such as the ground) such as a floor surface or a wall surface and the respective electrodes 41, 42, and 43.

If the hand H is caused to approach the head 20, a new capacitor that has a capacitance in accordance with the distances between the respective electrodes 41, 42, and 43 and the hand H is formed between the respective electrodes 41, 42, and 43 and the hand H. The capacitance around the respective electrodes 41, 42, and 43 increases in accordance with the capacitance of the new capacitor. The capacitive sensor 40 detects that the hand H has approached the head 20 on the basis of such change in capacitance.

However, in a case in which there is a conductor connected to a reference potential point between the respective electrodes 41, 42, and 43 and the front surface 20*a* of the head 20, the conductor connected to the reference potential point functions as an electrostatic shield, and a new capacitor cannot thus be formed between the respective electrodes 41, 42, and 43 and the hand H. In a case in which the conductive head 24 is connected to the reference potential point, for example, change in the capacitance between the respective electrodes 41, 42, and 43 and the conductive head 24 that accompanies vibration of the head 20 is detected by the capacitive sensor 40. That is, hitting of the head 20 can be detected by the capacitive sensor 40. However, the capacitive sensor 40 cannot detect that the hand H has been caused to approach the head 20, in particular, that the hand H has been brought into contact with the head 20 in this case.

Meanwhile, in a case in which one or more kind selected from a conductor that is not connected to a reference potential point and an insulating body is present between the respective electrodes 41, 42, and 43 and the front surface 20*a*, a new capacitor can be formed between the first electrode 41 and the hand H. In the embodiment, the first head 22 and the second head 23 that are insulating bodies and the electrically isolated conductive head 24 (a complex of the conductor and the insulating body) are located between the respective electrodes 41, 42, and 43 and the front surface 20*a*. That is, since there is no conductor connected to the reference potential point between the respective electrodes 41, 42, and 43 and the front surface 20*a*, it is possible to detect that the hand H has been caused to approach the head 20 and that the hand H has been brought into contact with the head 20 in the embodiment.

Note that the shell 12 that is a conductor is connected to the reference potential point via a wiring, which is not illustrated in the drawing. In this manner, since the shell 12 functions as an electrostatic shield, it is possible to prevent the capacitance detected by the capacitive sensor 40 from varying with change in the distance between the body portion 11 and the human body.

Figure 5:
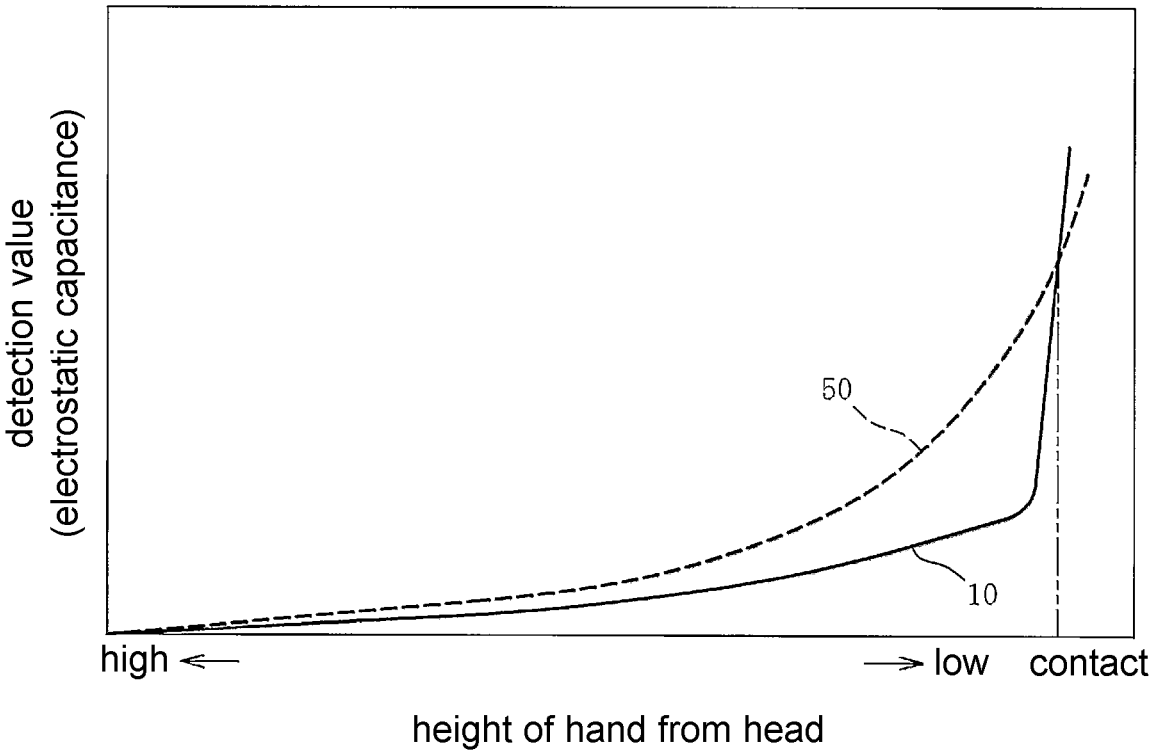
FIG. 5 is a graph illustrating detection values of a capacitive sensor in accordance with heights of a hand from the head.

Next, change in a detection value (capacitance between the respective electrodes 41, 42, and 43 and the hand H) of the capacitive sensor 40 depending on the presence of the conductive head 24 will be described with reference to FIG. 5. FIG. 5 is a graph illustrating a detection value of the capacitive sensor 40 in accordance with the height of the hand H from the head 20.

The horizontal axis of the graph in FIG. 5 represents the height of the hand H from the head 20. The horizontal axis indicates that the more being toward the left side from the contact position, the hand H is further away from the head 20 (the hand H is located at a higher position). The right side from the contact position indicates the amount of pressing when the hand H is further pressed against the head 20 from the contact position. The vertical axis represents a detection value (electrostatic capacitance) of the capacitive sensor 40. In FIG. 5, the detection value of the electronic percussion instrument 10 that has the conductive head 24 is represented by a solid line, and a detection value of an electronic percussion instrument 50 in a comparative example is represented by a dashed line. The electronic percussion instrument 50 is configured similarly to the electronic percussion instrument 10 other than that a head of an insulating body is used instead of the conductive head 24.

According to the electronic percussion instrument 50, a detection value exponentially increases as the head 20 approaches the hand H. Meanwhile, according to the electronic percussion instrument 10 that has the conductive head 24, an increase in the detection value is small until the hand H is brought into contact with the head 20, and the detection value increases rapidly at a time at which the hand H is brought into contact with the head 20. More specifically, the detection value increases rapidly at a time at which the distance between the head 20 and the hand H becomes 1 mm to 2 mm. Note that since there are few cases in which the hand H is not brought into contact with the head 20 when the distance between the head 20 and the hand H has been maintained at 1 mm to 2 mm, the fact that the distance between the head 20 and the hand H has become 1 mm to 2 mm may be regarded as a fact that the hand H has been brought into contact with the head 20.

A principle of the steep increase in the detection value due to the conductive head 24 will be described. A capacitor is formed between the hand H and the respective electrodes 41, 42, and 43, and the capacitance (the detection value of the capacitive sensor 40) of the capacitor changes in accordance with the distance between the hand H and the respective electrodes 41, 42, and 43. In a case in which the hand H and the head 20 are separated from each other by about 2 mm or greater, it is possible to ignore influences of the conductive head 24 on the capacitance of the capacitor between the hand H and the respective electrodes 41, 42, and 43.

If the distance between the hand H and the head 20 becomes 1 mm to 2 mm, the capacitance between the hand H and the conductive head 24 increases, and a situation that is substantially similar to a case in which an electric charge is exchanged between the hand H and the conductive head 24 is achieved. That is, a state that is substantially similar to a state in which the hand H and the conductive head 24 are electrically connected to each other is achieved even if the first head 22 is present between the hand H and the conductive head 24. Note that if the first head 22 is not present, the hand H is brought into contact with the conductive head 24, and a state in which the hand H and the conductive head 24 are electrically connected to each other is achieved.

In the state in which the hand H is electrically connected to the conductive head 24 (conductive portions 26), the hand H and the conductive head 24 serve as electrodes that face the respective electrodes 41. 42, and 43. Therefore, a situation that is similar to that in a case in which the area of the hand H (the electrode of the capacitor) has steeply increased is achieved at a timing at which the distance between the hand H and the head 20 is 1 mm to 2 mm, and the capacitance of the capacitor between the hand H and the respective electrodes 41, 42, and 43 steeply increases.

The control board 44 or an external device determines that the hand H has been brought into contact with the head 20 by the control board 44, the external device, or the like detecting such a steep increase in the detection value (a sudden change in a rate of increase in the detection value) of the capacitive sensor 40. As a result, it is possible to further facilitate determination of contact of the hand H with the head 20 in a case in which the conductive head 24 is provided than in a case in which no conductive head 24 is provided.

Note that if the resistance value of the conductive portion 26 in the fiber form per 1 cm is equal to or less than about 100 kΩ, it is possible to cause the detection value when the hand H is brought into contact with the head 20 (when the distance between the head 20 and the hand H becomes equal to or less than 1 mm to 2 mm) to sufficiently steeply increase. Therefore, it is possible to facilitate determination of the fact that the hand H has been brought into contact with the head 20 from the steep increase in the detection value.

Here, the detection value of the distance between the head 20 and the hand H obtained by the capacitive sensor 40 differs in accordance with various conditions such as the areas of the respective electrodes 41, 42, and 43, and the size of the hand H. Therefore, in a case in which it is determined that the hand H has been brought into contact with the head 20 when the detection value of the capacitive sensor 40 exceeds a predetermined threshold value, it is necessary to appropriately set the threshold value of the detection value in accordance with various conditions.

Meanwhile, it is determined that the hand H has been brought into contact with the head 20 (the distance between the head 20 and the hand H has become equal to or less than 1 mm to 2 mm) on the basis of the steep increase in the detection value of the capacitive sensor 40, specifically, on the basis of the fact that a first-order differential value (rate of increase) of the capacitance between the hand H and the respective electrodes 41, 42, and 43 has exceeded a predetermined threshold value in the embodiment. Since change in the rate of increase in the capacitance value (detection value) in accordance with various conditions is small, it is possible to facilitate setting of the threshold value for the rate of increase in the capacitance and to facilitate determination of contact of the hand H with the head 20.

Also, in a case in which the hand H is caused to be in contact with the head 20 for muting, the hand H is frequently held over the head 20 before and after the muting. The hand H is also frequently held over the head 20 before and after hitting in a case in which the head 20 is hit directly by the hand H to cause music sound. In such a case, it may be determined that the hand H has been brought into contact with the head 20 regardless of the fact that the hand H is just held over the head 20 according to the electronic percussion instrument 50. Therefore, muting or music sound generation may occur unintentionally. Meanwhile, according to the electronic percussion instrument 10, it is possible to facilitate determination of whether or not the hand H has been brought into contact with the head 20 using the conductive head 24 and thereby to inhibit occurrence of unintended muting and music sound generation.

According to the electronic percussion instrument 50, a gradient of a curve near the contact position is low, the change in the detection position with respect to an error of the detection value is large, and erroneous determination thus tends to occur. Meanwhile, according to the electronic percussion instrument 10, an inclination of a curve near the contact position is steep, the change in the detection position with respect to an error of the detection value is small, and erroneous determination thus tends not to occur.

According to the electronic percussion instrument 10, the detection value of the capacitive sensor 40 steeply increases due to the hand H being brought into contact with the first head 22 disposed on the side of the front surface 20*a* of the conductive head 24 even if the hand H is not brought into direct contact with the conductive head 24 as described above. In this manner, it is possible to facilitate determination of contact of the hand H with the head 20 while protecting the conductive head 24 from the sticks, the hand H, and the like at the time of hitting.

Also, if the head 20 is pressed with the hand H after the hand H is brought into contact with the head 20, the detection value of the capacitive sensor 40 further increases in accordance with the amount of pressing. In this manner, it is possible to detect the fact that the head 20 has been pressed after the hand H is brought into contact with the head 20 and the amount of pressing of the head 20 with the capacitive sensor 40. As a result, it is possible to cause the electronic music sound to become different due to contact of the hand H with the head 20 and the pressing of the head 20 and to cause the electronic music sound to change in accordance with the amount of pressing of the head 20.

Figure 6:
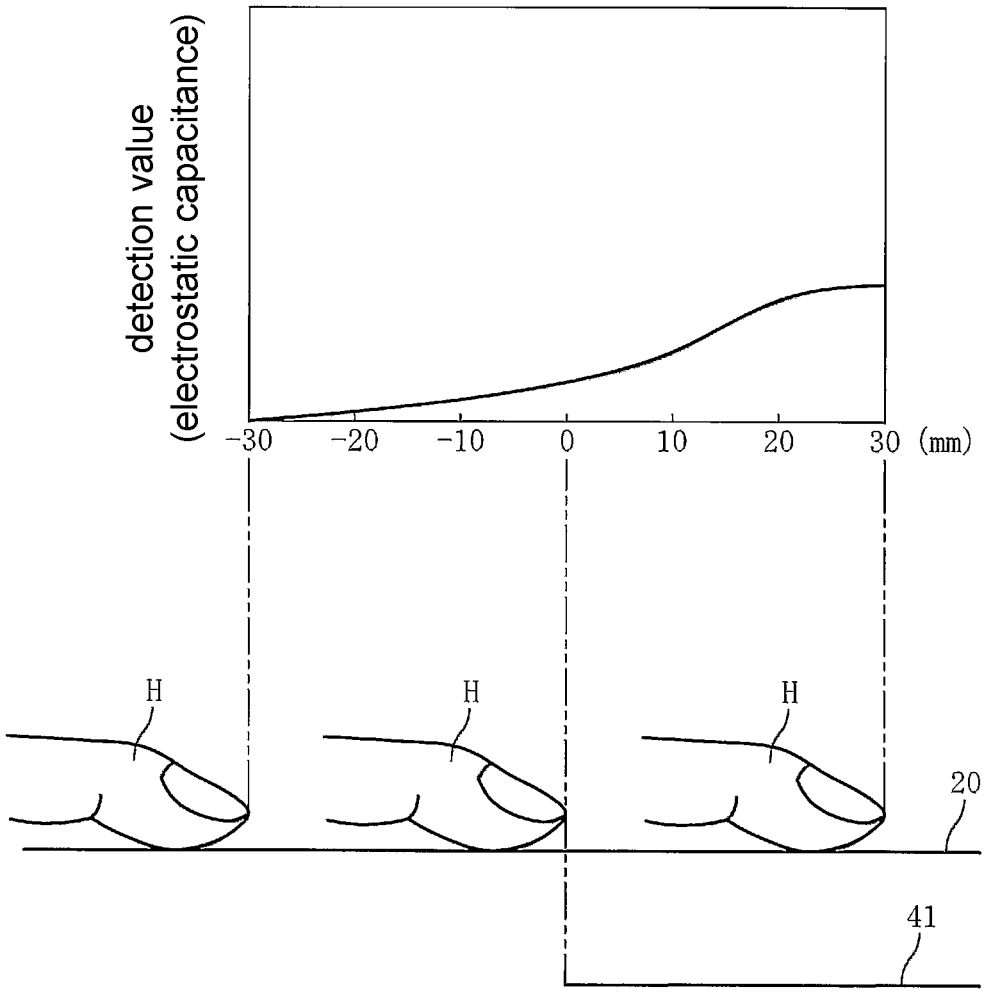
FIG. 6 is a graph illustrating detection values of the capacitive sensor in accordance with contact positions of the hand.

Next, a positional relationship between the conductive portions 26 of the conductive head 24 and the respective electrodes 41, 42, and 43 will be described with reference to FIG. 4 and FIG. 6. FIG. 6 is a graph illustrating detection values of the capacitive sensor 40 in accordance with contact positions of the hand H with the head 20.

As illustrated in FIG. 4, the plurality of conductive portions 26 provided so as to extend in the first direction A are disposed such that the conductive portions 26 are separated from each other in the second direction B. The first electrode 41 and the second electrode 42 are disposed to be away from each other in the second direction B such that the first electrode 41 and the second electrode 42 are located on both sides of a straight line parallel to the first direction A, relative to the plurality of conductive portions 26. That is, one electrode is divided into two electrodes in the second direction B such that the two electrodes are located on both sides of the straight line parallel to the first direction A, and the first electrode 41 and the second electrode 42 are thus provided.

In a case in which the conductive portions 26 are provided in parallel to a boundary line of the first electrode 41 and the second electrode 42 in a top view in this manner, the hand H is caused to approach the head 20 while the position of the hand H is changed from a location immediately above the second electrode 42 to a location immediately above the first electrode 41. The detection value of the capacitive sensor 40 in relation to the first electrode 41 when the hand H is caused to be in contact with the head 20 at each position is illustrated in FIG. 6.

The vertical axis of the graph in FIG. 6 represents the detection value of the capacitive sensor 40 in relation to the first electrode 41. The horizontal axis of the graph in FIG. 6 represents a distance between the edge of the first electrode 41 and the tip end of the hand H. Note that a relationship between the edge of the first electrode 41 and the tip end of the hand H is schematically illustrated below the horizontal axis.

In a case in which the hand H is not located immediately above the first electrode 41 (in a case in which the value of the horizontal axis is less than 0 mm in the graph in FIG. 6), the detection value of the capacitive sensor 40 hardly changes. Meanwhile, in a case in which the hand H is located immediately above the first electrode 41 (in a case in which the value of the horizontal axis is equal to or greater than 0 mm), the detection value of the capacitive sensor 40 gradually changes as the tip end of the hand H moves away from the edge of the first electrode 41 (as the area of the hand H located immediately above the first electrode 41 increases).

In a case in which the edge of the first electrode 41 and the tip end of the hand H are separated from each other by 20 mm or greater (the value of the horizontal axis is equal to or less than −20 mm), substantially no detection value of the capacitive sensor 40 in relation to the first electrode 41 is obtained. Note that substantially no detection value is not obtained in a case in which the first electrode 41 and the hand H are separated from each other by 20 mm or greater in a similar manner even if the detection value of the capacitive sensor 40 is caused to change as a whole, for example, by causing the distance between the first electrode 41 and the head 20 to change.

Meanwhile, a case in which the conductive portions 26 are provided in a bridged manner immediately above the first electrode 41 and the second electrode 42 (the conductive portions 26 are provided non-parallel to the boundary line of the first electrode 41 and the second electrode 42 in the top view) and the hand H is located immediately above the second electrode 42 will be examined. In such a case, if the plurality of conductive portions 26 located immediately below the hand H serve as electrodes over the entire length, the conductive portions 26 face both the first electrode 41 and the second electrode 42. Therefore, not only the detection value of the capacitive sensor 40 in relation to the second electrode 42 but also the detection value of the capacitive sensor 40 in relation to the first electrode 41 change in accordance with the height of the hand H.

The respective detection values of the capacitive sensor 40 depend on the area of the part at which the plurality of conductive portions 26 that serve as electrodes over the entire length and the respective electrodes 41 and 42 face each other. Therefore, in a case in which the area of the part at which the conductive portions 26 and the first electrode 41 face each other is the same as the area of the part at which the conductive portions 26 and the second electrode 42 face each other, the respective detection values of the capacitive sensor 40 becomes substantially the same as each other. Therefore, it is not possible to detect the contact position of the hand H with the head 20 if the conductive portions 26 are provided non-parallel to the boundary line between the first electrode 41 and the second electrode 42 in a top view.

Note that the change in the detection value of the capacitive sensor 40 in relation to the second electrode 42 with respect to the distance between the second electrode 42 and the hand H represents a behavior that is the same as that of the change in the detection value of the capacitive sensor 40 in relation to the first electrode 41 with respect to the distance between the first electrode 41 and the hand H irrespective of whether the boundary line between the first electrode 41 and the second electrode 42 is parallel to or not parallel to the conductive portion 26. As a result, it is possible to increase the difference between the detection value of the first electrode 41 and the detection value of the second electrode 42 in accordance with the contact position of the hand H with the head 20 by providing the conductive portions 26 in parallel to the boundary line between the first electrode 41 and the second electrode 42 in the top view according to the embodiment. In this manner, it is possible to facilitate detection of the contact position of the hand H with the head 20 from the difference. In particular, it is possible to facilitate detection regarding with which of the head 20 immediately above the first electrode 41 and the head 20 immediately above the second electrode 42 the hand H has been brought into contact.

In a case in which the first electrode 41 and the second electrode 42 are further divided into a plurality of electrodes in the second direction B, it is possible to detect the contact position of the hand H in more detail from differences in detection values of the respective divided electrodes. In a case in which the tip end of the hand H in contact with the head 20 and the edge of the first electrode 41 (the respective electrodes) are separated from each other by 20 mm or greater as described above, substantially no detection value of the capacitive sensor 40 in relation to the electrodes is obtained. Therefore, it is possible to determine that the hand H is in contact with the head 20 at a position that is separated from the electrodes from which substantially no detection value of the capacitive sensor 40 has been obtained by 20 mm or greater.

Detection sensitivities of the respective electrodes 41 and 42 can be uniformized by the shapes of the respective electrodes 41 and 42 (the shapes of the respective electrodes divided in the second direction B) being formed into the same shape. As a result, it is possible to improve detection accuracy of the contact position of the hand H based on differences in the detection values of the respective electrodes 41 and 42. Further, if the shapes of the respective electrodes 41 and 42 are the same, it is possible to differentiate the detection values in relation to the respective electrodes 41 and 42 in accordance with the areas of the parts at which the plurality of conductive portions 26 located immediately below the hand H and the respective electrodes 41 and 42 face each other even when the hand H is located above the boundary line of the respective electrodes 41 and 42. As a result, it is possible to facilitate the detection of the contact position of the hand H with the head 20 even when the hand H is located above the boundary line of the respective electrodes 41 and 42.

In addition, if the hand H located above the boundary line of the respective electrodes 41 and 42 is caused to move in the second direction B, some detection values increase while other detection values decrease in relation to the respective electrodes 41 and 42. In this manner, it is possible to detect movement in the movement direction of the hand H.

Figure 7:
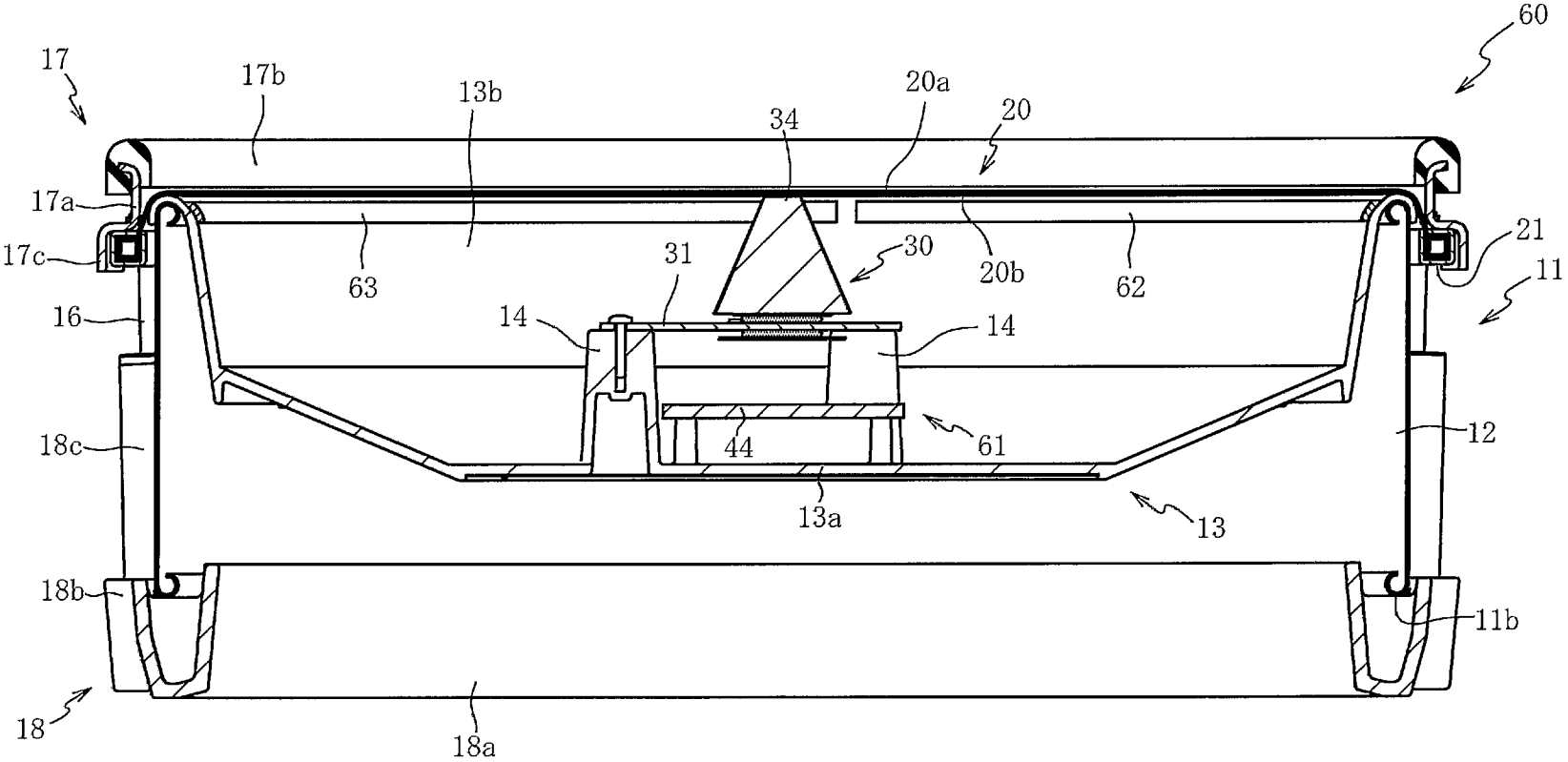
FIG. 7 is a sectional view of an electronic percussion instrument according to a second embodiment.

Next, a second embodiment will be described with reference to FIG. 7, FIG. 8, and FIG. 9. In the first embodiment, the case in which the respective electrodes 41, 42, and 43 of the capacitive sensor 40 are provided to face the head 20 has been described. Meanwhile, a case in which a first electrode 62 and a second electrode 63 (hereinafter, referred to as "the respective electrodes 62 and 63") of a capacitive sensor 61 are provided in an inner peripheral surface of the body portion 11 will be described in the second embodiment. Note that the same reference numerals will be given to parts that are the same as those in the first embodiment, and description thereof will be omitted below.

First, an electronic percussion instrument 60 according to the second embodiment will be described with reference to FIG. 7. FIG. 7 is a sectional view of the electronic percussion instrument 60. As illustrated in FIG. 7, the capacitive sensor 61 of the electronic percussion instrument 60 is a self-capacitance sensor that detects that a detection target conductor such as a human body has approached the head 20. The capacitive sensor 61 includes the first electrode 62, a second electrode 63, and a control board 44. The respective electrodes 62 and 63 are electrically connected to the control board 44.

The respective electrodes 62 and 63 are strip-shaped conductors that are respectively attached to an inner peripheral surface of the body portion 11 (the side wall portion 13*b* of the frame 13) over a half periphery. In this manner, it is possible to omit a part of the projecting portions 14 and the rib 15 provided at the frame 13.

The respective electrodes 62 and 63 can be regarded as having been obtained by equally dividing an electrode with an annular shape in a top view that is attached to the entire periphery of the inner peripheral surface of the body portion 11 into two electrodes. The respective electrodes 62 and 63 are inclined toward the center of the body portion 11 toward the lower side.

Next, detection values of the capacitive sensor 61 will be described with reference to FIG. 8 and FIG. 9. FIG. 8 is a schematic view illustrating a positional relationship between the conductive portions 26 of the conductive head 24 and the respective electrodes 62 and 63. As illustrated in FIG. 8, the plurality of conductive portions 26 provided to extend in the first direction A are disposed to be away from each other in the second direction B. The first electrode 62 and the second electrode 63 are disposed to be away from each other in the first direction A such that the first electrode 62 and the second electrode 63 are located on both sides of a straight line parallel to the second direction B relative to the plurality of conductive portions 26. That is, the annular electrode is divided into two electrodes in the first direction A, and the first electrode 62 and the second electrode 63 are thus provided.

Figure 8:
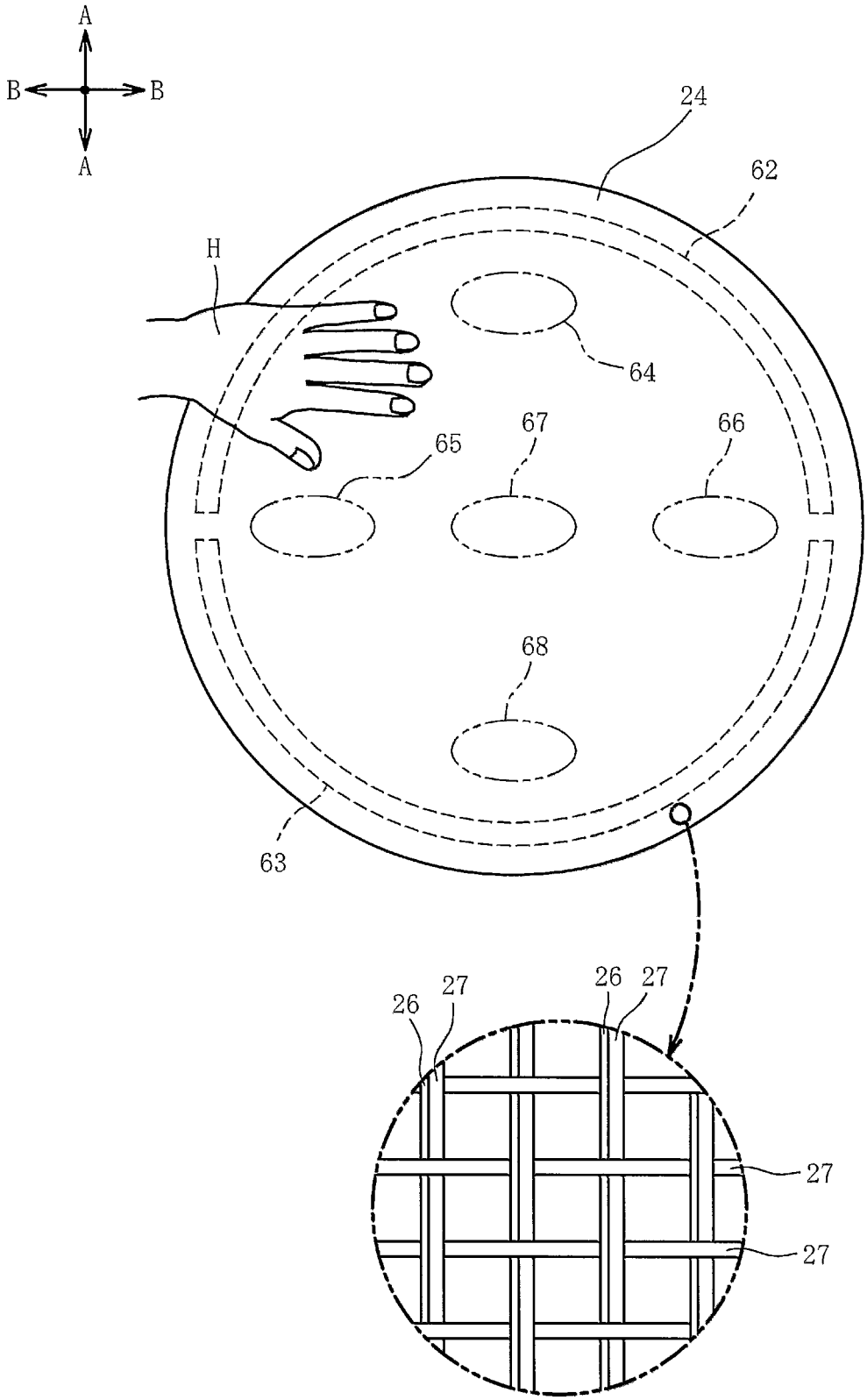
FIG. 8 is a schematic view illustrating a positional relationship between a conductive head and each electrode.
Figure 9:
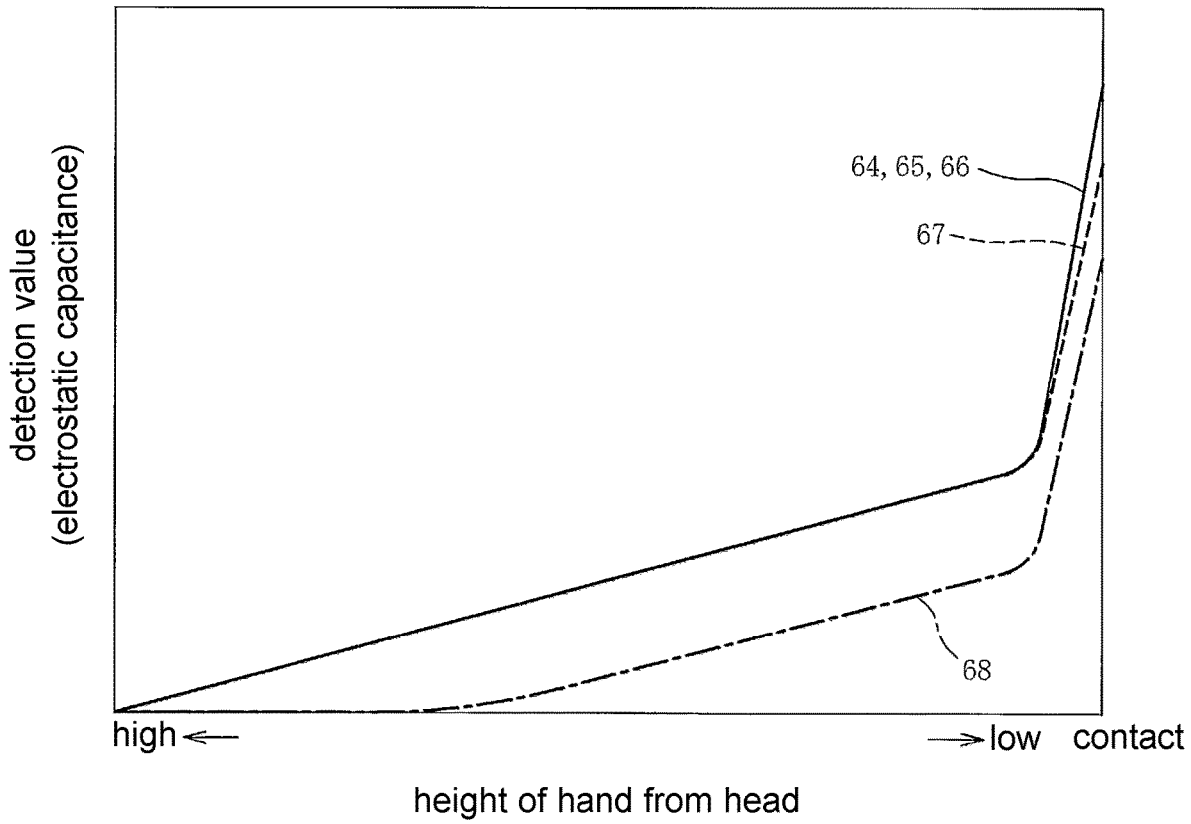
FIG. 9 is a graph illustrating detection values of a capacitive sensor in accordance with contact positions of a hand.

Change in the detection values of the capacitive sensor 61 in relation to the first electrode 62 in accordance with the height of the hand H from the head 20 at positions 64 to 68 of the conductive head 24 (head 20) illustrated in FIG. 8 is illustrated in FIG. 9. In FIG. 9, the graph of the detection value at the position 64 is represented by a solid line. Note that the graph of the detection values at the positions 65 and 66 is substantially the same as the graph of the detection value at the position 64. In FIG. 9, the graph of the detection value at the position 67 is represented by a dashed line. In FIG. 9, the graph of the detection value at the position 68 is represented by a one-dotted chain line. The horizontal axis in FIG. 9 represents the height of the hand H from the head 20 and indicates that the more being toward the left side from the contact position, the higher position at which the hand H is located. The vertical axis represents detection values of the capacitive sensor 61.

The increase in the detection value until the hand H is brought into contact with the head 20 is small at any of the positions 64 to 68, and the detection value steeply increases when the hand H is brought into contact with the head 20. As a result, it is possible to facilitate determination of the contact of the hand H with the head 20 by the conductive head 24 similarly to the first embodiment.

The detection value of the capacitive sensor 61 when the hand H is brought into contact with the head 20 is the largest at the positions 64 and 66, is the second largest at the position 67, and is the smallest at the position 68. That is, the detection value at the time of the contact with the head 20 increases at a position that is closer to the first electrode 62.

Note that the change in the detection value of the capacitive sensor 61 in relation to the second electrode 63 represents a behavior that is the same as that of the change in the detection value of the capacitive sensor 61 in relation to the first electrode 62. That is, in the graph of the detection values of the capacitive sensor 61 in relation to the second electrode 63, the positions 65, 66, and 68 are represented by a solid line, the position 67 is represented by a dashed line, and the position 64 is represented by a one-dotted chain line.

Such change in the detection value of the capacitive sensor 61 is caused because the conductive portions 26 located immediately below the hand H serve as electrodes over the entire length and the conductive portions 26 that serve as electrodes extend up to the vicinity of the respective electrodes 62 and 63. In his manner, it is possible to cause the detection value of the capacitive sensor 61 to change in accordance with the height of the hand H from the head 20 by the conductive head 24 (conductive portions 26) even if the respective electrodes 62 and 63 are attached to the inner peripheral surface of the body portion 11.

Further, as the distance between the contact position of the hand H with the head 20 to the first electrode 62 increases, the resistance of the conductive portion 26 therebetween increases. Also, since the area in which the conductive portions 26 and the respective electrodes 62 and 63 face each other is smaller in the second embodiment than in the first embodiment, the detection value of the capacitive sensor 61 becomes smaller as a whole. Therefore, the detection value of the capacitive sensor 61 tends to change in accordance with the resistance of the conductive portion 26. As a result, the detection value of the capacitive sensor 61 decreases as the positions 64 to 68 are further away from the respective electrodes 62 and 63. In this manner, it is possible to detect which of the positions of the head 20 in the first direction A the hand H has been brought into contact with from the difference between the detection value of the first electrode 62 and the detection value of the second electrode 63.

Note that it is possible to differentiate the detection values of the respective electrodes 62 and 63 divided in the second direction B similarly to the first embodiment by dividing the respective electrodes 62 and 63 in the second direction B such that the respective electrodes 62 and 63 are located on both sides of a straight line parallel to the first direction A. As a result, it is possible to detect the contact position of the hand H with the head 20 in the second direction B.

Although the disclosure has been described above on the basis of the aforementioned embodiments, it is possible to easily expect that the disclosure is not limited by the aforementioned embodiments and that various modifications can be made without departing from the gist of the disclosure. For example, the disclosure is not limited to the case in which the respective electrodes 41, 42, 43, 62, and 63 are inclined with respect to the head 20, and the head 20 and the respective electrodes 41, 42, 43, 62, and 63 may be fully parallel to each other. Also, the head 20 and the respective electrodes 62 and 63 may be fully perpendicular to each other. Further, both the respective electrodes 41, 42, and 43 and the respective electrodes 62 and 63 may be provided together.

Although the electronic percussion instruments 10 and 60 that imitate drums have been described in the aforementioned respective embodiments, the disclosure is not necessarily limited thereto. The conductive head 24 and the capacitive sensors 40 and 61 may be provided in an electronic percussion instrument that imitates a percussion instrument other than a drum, in which at least one of both ends in an axial direction of the tubular body portion 11 is opened and the opening is covered with the head 20. Examples of the percussion instrument other than a drum include a Peruvian percussion instrument (cajon), a conga, a bongo, a timbales, a timpani, and the like.

Note that the body portion 11 may be formed into a tubular shape other than the cylindrical shape in accordance with the percussion instrument to be imitated. The shapes of the frame 13, the head 20, the rim 17, the respective electrodes 41, 42, 43, 62, and 63, and the like are determined in accordance with the shape of the body portion. Also, a part of a human body (a foot or the like) other than the hand H may be a detection target conductor in accordance with the percussion instrument to be imitated. In a case in which sticks or the like are caused to be brought into contact with the head 20, the sticks or the like may be connected to a reference potential point such as a human body, ground, or the like, and the sticks or the like may be regarded as detection target conductors.

Although the case in which the conductive head 24 is made of a plainly woven network-form material has been described in the aforementioned first embodiment, the disclosure is not necessarily limited thereto. The conductive head 24 may be made of a twilled or satin-woven network-form material or the like. Also, the conductive head 24 may be made of a synthetic resin film, a rubber plate, a metal plate, a metal foil, or the like with conductivity. The conductive head 24 may be formed by the plurality of conductive portions 26 being secured to the non-conductive portions 27 made of insulating bodies such as films, woven elements, or knitted elements through adhesion or the like. The plurality of conductive portions 26 may be disposed in each of the first direction A and the second direction B. Also, the plurality of conductive portions 26 provided so as to extend in the first direction A may be caused to be in contact with each other in the second direction B. Also, the conductive head 24 may be formed by causing the entire fibers to serve as the conductive portions 26. Note that the conductive portions 26 are not limited to carbon fibers, and elements obtained by covering front surfaces of fibers made of wires, metal fibers, conductive polymer fibers, or insulating bodies with conductors may be used.

Although the case in which a part of the center of the conductive head 24 is bonded at least one of the first head 22 and the second head 23 with the joint portion 25 has been described in the aforementioned first embodiment, the disclosure is not necessarily limited thereto. The joint portion 25 may be provided over substantially the entire surface of the conductive head 24, or the joint portion 25 may be provided successively or intermittently at the outer edge of the conductive head 24. Also, the first head 22 and the second head 23 on the outer side of the conductive head 24 may be bonded to each other with the joint portion 25. In this case, it is possible to restrict movement of the conductive head 24 relative to the first head 22 and the second head 23 with the joint portion 25 without bonding the conductive head 24 to the first head 22 and the second head 23.

Also, the joint portion may be omitted. Further, an insulating body may be integrated with at least a part of the outer edge of the conductive head 24 while the joint portion is omitted. It is possible to secure the conductive head 24 to the frame portion 21 while keeping the conductive head 24 away from the conductor such as the frame portion 21 by securing the insulating body to the frame portion 21.

Although the head 20 in which the conductive head 24 is pinched between the first head 22 and the second head 23 has been described in the aforementioned first embodiment, the disclosure is not necessarily limited thereto. One of or both the first head 22 and the second head 23 may be omitted. In this case, the outer edge of the conductive head 24 or the insulating body integrated with the outer edge are secured to the frame portion 21. However, substantially the entire surface and the outer edge of the conductive head 24 may be bonded to the first head 22 or the second head 23 with the joint portion 25 in a case in which the first head 22 or the second head 23 is provided.

The case in which the respective electrodes 41, 42, and 43 are provided by equally dividing an electrode with a circular shape in a top view into three electrodes in the circumferential direction has been described in the aforementioned first embodiment. The case in which the respective electrodes 62 and 63 are provided by equally dividing an electrode with an annular shape in a top view into two electrodes in the circumferential direction has been described in the aforementioned second embodiment. However, the disclosure is not necessarily limited thereto. The number of electrodes to be divided, the dividing direction, the shapes of the respective divided electrodes, and the like may be appropriately changed. Also, a circular or annular electrode may be used without being divided.

Although the case in which the capacitive sensors 40 and 61 are of self-capacitance types has been described in the aforementioned respective embodiments, the disclosure is not necessarily limited thereto. Mutual-capacitance capacitive sensors may be used. According to the mutual-capacitance capacitive sensors, an electric charge is supplied to one of a pair of electrodes, an electric field is formed (capacitance is induced) between the pair of electrodes via the conductive head 24, and a decrease in the capacitance between the pair of electrodes due to movement of a part of the electric field to the hand H due to approach of the hand H to the conductive head 24 is detected. Since the pair of electrodes for forming the electric field is required by the mutual-capacitance capacitive sensors, electrode patterns and control circuits become complicated. Meanwhile, the self-capacitance capacitive sensors 40 and 61 enable simplification of the electrodes and the control circuits.

Although the case in which the shell 12 is a conductor has been described in the aforementioned first embodiment, the disclosure is not necessarily limited thereto. The shell 12 may be formed of an insulating body such as a wood material or synthetic resin. It is possible to further reduce the change in capacitance detected by the capacitive sensor 40 in response to approach of a human body or the like to the shell 12 as a dielectric constant of the insulating body forming the shell 12 decreases.

Note that a conductive film may be attached to at least one of the inner peripheral surface and the outer peripheral surface of the shell 12, at least one of the inner peripheral surface and the outer peripheral surface of the shell 12 may be coated with a conductive paint, or a conductive plate may be disposed between the respective electrodes 41, 42, and 43 and the shell 12 even in a case in which the shell 12 is made of the insulating body. The conductive film, the conductive paint, or the conductive plate functions as an electrostatic shield by connecting the conductive film, the conductive paint, or the conductive plate to the reference potential point.

In addition, if at least a part of the frame portion 21, the frame contact portion 17*a*, the flange 17*c*, the tube portions 18*c*, the bolts 16, and the frame 13 is formed of a conductor and is connected to the reference potential point, the conductor connected to the reference potential point functions as an electrostatic shield.

Although the case in which the head sensor 33 and the rim sensor 35 are sensors including piezoelectric elements has been described in the aforementioned first embodiment, the disclosure is not necessarily limited thereto, it is a matter of course that vibration sensors including elements other than the piezoelectric elements can be used. Also, the head sensor for detecting pressing force from the cushion 34 can also be formed using a pressure sensitive sensor such as a membrane switch. In addition, the rim sensor can also be formed using a pressure sensor such as a membrane switch configured to be pressed through elastic deformation of the elastic member 17*b* of the rim 17. Note that the head sensor 33 and the rim sensor 35 may be omitted.

Although the case in which it is determined that the hand H has been brought into contact with the head 20 (the distance between the head 20 and the hand H has become equal to or less than 1 mm to 2 mm) when the first-order differential value of the capacitance (detection value) between the hand H and the respective electrodes 41, 42, and 43 exceeds a predetermined threshold value has been described in the aforementioned first embodiment, the disclosure is not necessarily limited thereto. For example, the rate of increase in the capacitance may be acquired as a difference in capacitance before and after a predetermined time instead of the first-order differential value of the capacitance. In addition, it may be determined that the hand H has been brought into contact with the head 20 in a case in which the capacitance steeply increases such that the increase significantly deviates from a successive increase trend after a successive increase in the capacitance (in a case in which the increase trend of the capacitance changes).

It may be determined that the hand H has been brought into contact with the head 20 on the basis of the fact that a higher-order differential value such as a second-order differential value or a third-order differential value of the capacitance exceeds a predetermined threshold value. The higher-order differential value indicates how the rate of increase in the capacitance increases, and the higher-order differential value also steeply increases due to a steep increase in the capacitance induced by the provision of the conductive head 24. That is, it is possible to state that the contact of the hand H with the head 20 is determined on the basis of the rate increase in the capacitance even in the case in which the higher-order differential value is used.

In addition, a value of capacitance until the hand H is brought into contact with the head 20 after the distance between the head 20 and the hand H becomes equal to or less than 1 mm to 2 mm may be set as a threshold value, and it may be determined that the hand H has been brought into contact with the head 20 when the capacitance exceeds the threshold value. In this case, it is possible to prevent determination that the hand H has been brought into contact with the head 20 regardless of the situation that the hand H is away from the head 20 due to an increase in the rate of increase in the capacitance induced by how the hand H is moved. Also, a plurality of various conditions for determining that the hand H has been brought into contact with the head 20 may be used in combination.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic percussion instrument comprising:

a tubular body portion with an end surface in an axial direction open;

a head that covers the end surface open in the axial direction of the tubular body portion and has a front surface adapted to be hit; and a capacitive sensor that has an electrode disposed on a rear surface side of the head, wherein the head includes a conductive head that is electrically isolated, no conductor connected to a reference potential point is provided between the front surface of the head and the electrode, and the head is configured that as a detection target conductor is brought into contact with the head, the conductive head and the detection target conductor serve as electrodes which face the electrode of the capacitive sensor.

2. The electronic percussion instrument according to claim 1, wherein the head includes a first head that is an insulating body disposed on a front surface side of the conductive head.

3. The electronic percussion instrument according to claim 2, further comprising:

an annular rim that is secured on an outer peripheral side of the tubular body portion, wherein the head includes a second head that is an insulating body disposed on a rear surface side of the conductive head, and an annular frame portion, to which outer edges of the first head and the second head are secured, and which is pressed with the annular rim and applies a tensile force to the first head and the second head, and the conductive head is disposed on an inner side beyond a contact position between the second head and the tubular body portion.

4. The electronic percussion instrument according to claim 1, wherein the conductive head includes a plurality of conductive portions that are conductors provided so as to extend in a first direction, and a non-conductive portion, to which the plurality of conductive portions are secured, and which is an insulating body, the plurality of conductive portions are separated from each other in a second direction that is orthogonal to the first direction, and the electrode is divided into a plurality of electrodes in the second direction such that the plurality of electrodes are located on both sides of a straight line parallel to the first direction.

5. The electronic percussion instrument according to claim 4, wherein the conductive portions are provided in parallel to a boundary line of adjacent electrodes among the plurality of divided electrodes, in a top view.

6. The electronic percussion instrument according to claim 1, wherein the conductive head includes a plurality of conductive portions that are conductors provided so as to extend in a first direction, and a non-conductive portion, to which the plurality of conductive portions are secured, and which is an insulating body, the plurality of conductive portions are separated from each other in a second direction that is orthogonal to the first direction, and the electrode is divided into a plurality of electrodes in the first direction such that the plurality of electrodes are located on both sides of a straight line parallel to the second direction.

7. The electronic percussion instrument according to claim 6, wherein the plurality of electrodes are obtained by equally dividing an electrode with an annular shape in a top view attached to an entire periphery of an inner peripheral surface of the tubular body portion into two electrodes.

8. The electronic percussion instrument according to claim 7, wherein the conductive portions are provided so as to be perpendicular to a boundary line of the two electrodes, in a top view.

9. The electronic percussion instrument according to claim 4, wherein the conductive portions have a resistance value of 100 kΩ or less per 1 cm.

10. An electronic percussion instrument comprising:

a tubular body portion with an end surface in an axial direction open;

a head that covers the end surface open in the axial direction of the tubular body portion and that has a front surface adapted to be hit;

an annular rim that is secured on an outer peripheral side of the tubular body portion;

an annular frame portion, to which an outer edge of the head is secured, and which is pressed with the annular rim and applies a tensile force to the head; and a capacitive sensor that has an electrode disposed on a rear surface side of the head, wherein the head is provided such that a conductive head is pinched between a first head of an insulating body and a second head of the insulating body in order for the conductive head to be electrically isolated, and the head is configured that as a detection target conductor is brought into contact with the head, the conductive head and the detection target conductor serve as electrodes which face the electrode of the capacitive sensor.

11. The electronic percussion instrument according to claim 10, wherein the conductive head is provided with a joint portion that restricts a relative displacement of the conductive head with respect to the first head and the second head.

12. The electronic percussion instrument according to claim 10, wherein a diameter of the conductive head is smaller than an inner diameter of the annular frame portion.

13. The electronic percussion instrument according to claim 10, wherein the conductive head is disposed on an inner side beyond a contact position between the second head and the tubular body portion.

14. The electronic percussion instrument according to claim 10, wherein the conductive head includes a network-form plainly woven material of first fibers extending in a first direction and second fibers extending in a second direction that is orthogonal to the first direction, the second fibers are fibers that form non-conductive portions, and the first fibers are fibers that are a combination of conductive portions and non-conductive portions, the conductive portions being separated from each other in the second direction due to the non-conductive portions being disposed between adjacent conductive portions.

15. The electronic percussion instrument according to claim 10, wherein the electrode includes a plurality of electrodes divided at equal intervals in a circumferential direction of the tubular body portion with respect to an axis center of the tubular body portion.

16. The electronic percussion instrument according to claim 15, wherein the conductive portions of the first fibers are provided in parallel to a boundary line of adjacent electrodes among the plurality of electrodes, in a top view.

17. The electronic percussion instrument according to claim 15, wherein the conductive portions of the first fibers are provided so as to be perpendicular to a boundary line of adjacent electrodes among the plurality of electrodes, in a top view.

18. The electronic percussion instrument according to claim 10, wherein no conductor connected to a reference potential point is provided between the front surface of the head and the electrode.

19. The electronic percussion instrument according to claim 14, wherein the conductive portions have a resistance value of 100 kΩ or less per 1 cm.

20. An electronic percussion instrument comprising:

a head that has a front surface adapted to be hit, has a conductivity, and is electrically isolated; and a capacitive sensor that is disposed on a rear surface side of the head and induces a capacitance in accordance with a distance from a detection target conductor located on a front surface side of the head, and the head is configured that as a detection target conductor is brought into contact with the head, the head and the detection target conductor serve as electrodes which face an electrode of the capacitive sensor.

21. A detection method, using an electronic percussion instrument that includes a head that is electrically isolated and has a conductivity and a capacitive sensor that is disposed on a rear surface side of the head, the detection method comprising:

determining that a detection target conductor has approached the head beyond a predetermined distance, on the basis of a rate of change in a capacitance between the capacitive sensor and the detection target conductor in accordance with a distance between the detection target conductor and the head, wherein the head is configured that as the detection target conductor is brought into contact with the head, the head and the detection target conductor serve as electrodes which face an electrode of the capacitive sensor.

22. An electronic percussion instrument comprising:

a head that includes an electrically isolated conductive head and has a front surface adapted to be hit; and a capacitive sensor that has an electrode disposed on a rear surface side of the head, wherein an area of a portion of the electrically isolated conductive head facing the electrode is larger than an area of a hand, and the head is configured that as the hand is brought into contact with the head, the head and the hand serve as electrodes which face the electrode of the capacitive sensor.

* * * * *